US007922879B2

(12) United States Patent
Kodama et al.

(10) Patent No.: US 7,922,879 B2
(45) **Date of Patent: *Apr. 12, 2011**

(54) ION EXCHANGE MEMBRANE ELECTROLYZER

(75) Inventors: Yoshiyuki Kodama, Tamano (JP); Shinichiro Yamamoto, Tamano (JP)

(73) Assignees: Chlorine Engineers Corp., Ltd., Tokyo (JP); Tosoh Corporation, Shunan-shi (JP)

( * ) Notice: Subject to any disclaimer, the term of this patent is extended or adjusted under 35 U.S.C. 154(b) by 1037 days.

This patent is subject to a terminal disclaimer.

(21) Appl. No.: 11/783,322

(22) Filed: Apr. 9, 2007

(65) Prior Publication Data

US 2007/0235338 A1 Oct. 11, 2007

(30) Foreign Application Priority Data

Apr. 10, 2006 (JP) ..... 2006-107331

(51) Int. Cl.
*C25B 9/02* (2006.01)
*C25B 9/12* (2006.01)

(52) U.S. Cl. ..... 204/283; 204/252; 204/255; 204/257; 204/263; 204/286.1; 204/288.3; 204/288.6

(58) Field of Classification Search ..... 204/283, 204/252, 255, 257, 263, 286.1, 288.3, 288.6
See application file for complete search history.

(56) References Cited

U.S. PATENT DOCUMENTS 4,096,054 A 6/1978 Specht et al.
7,763,152 B2 * 7/2010 Suzuki et al. ..... 204/252
2003/0188966 A1 * 10/2003 Katayama ..... 204/297.14
2007/0235338 A1 10/2007 Kodama et al.

FOREIGN PATENT DOCUMENTS

EP 1 378 589 A1 1/2004
EP 1378589 A1 1/2004
FR 2 576 325 A1 7/1986

OTHER PUBLICATIONS

European Search Report dated Sep. 29, 2008 issued in corresponding European Patent Application No. 07105863.0.

* cited by examiner

*Primary Examiner* — Harry D Wilkins, III
*Assistant Examiner* — Zulmariam Mendez
(74) *Attorney, Agent, or Firm* — Westerman, Hattori, Daniels & Adrian, LLP

(57) ABSTRACT

An ion exchange membrane electrolyzer is provided, which is characterized in that a current is passed through at least one electrode in contact with a plate spring member formed at a portion of an electrode retainer member parallel with a flat plate form of electrode chamber partition, wherein said electrode retainer member is joined at a belt junction to the flat plate form of electrode chamber partition with a space between them, said electrode is provided with a floating mount means at a portion thereof other than a portion of contact with the plate spring member, and said floating mount means is provided with an engaging portion that is engaged with a fixed engaging member to enable said electrode to move in a perpendicular direction to an electrode surface and in a range of displacement of said plate spring member.

8 Claims, 4 Drawing Sheets

ION EXCHANGE MEMBRANE ELECTROLYZER

CROSS-REFERENCED TO RELATED APPLICATIONS

This application is based upon and claims the benefit of priority from prior Japanese Patent Application No. 2006-107331, filed Apr. 10, 2006, the entire contents of which are incorporated herein by reference.

BACKGROUND

1. Technical Field

The present invention relates generally to an ion exchange membrane electrolyzer, and more particularly to an ion exchange membrane electrolyzer capable of keeping an inter-electrode spacing as predetermined.

2. Related Art

Referring to an electrolyzer used for the electrolysis of aqueous solutions, the voltages taken for electrolysis are governed by various factors. In particular, the spacing between an anode and a cathode has large influences on electrolyzer voltage. Accordingly, the inter-electrode spacing is reduced so that the electrolyzer voltage is lowered to cut down the energy consumptions necessary for electrolysis.

In an ion exchange membrane electrolyzer or the like used for the electrolysis of brine, the electrolyzer voltage is lowered by bringing three members, anode, ion exchange membrane and cathode, into close contact with one another. When it comes to a large electrolzyer with an electrode area of as large as a few square meters, however, much difficulty is experienced in bringing the anode and cathode coupled to an electrode chamber by a rigid member into close contact with an ion exchange membrane thereby diminishing and keeping an inter-electrode spacing at a given value.

With this in mind, there has been an electrolyzer proposed, wherein a flexible member is used for either one of the anode or cathode to make the inter-electrode spacing adjustable. For instance, there is an electrode put forward, in which a flexible member made of fine metal wires in the form of a woven fabric, unwoven fabric, network or the like is located on a porous electrode substrate.

Because such electrodes have a flexible member made of fine metal wires, however, when they are overly urged by counter pressure from a counter electrode, there are some problems: an uneven inter-electrode spacing due to partial deformation of the flexible member, and fine wires sticking in the ion exchange membrane.

JP-A-57-108278 or JP-A-58-37183 has also proposed an electrolyzer wherein conductive connections are made by a number of plate spring members between an electrode chamber partition side and an electrode.

The flexible electrodes using plate spring pieces are improved over those using members comprising fire wires in terms of their behavior in association with partial deformation upon pressurization. In these electrolyzers, however, all the plate spring pieces extend obliquely from a flexible cathode retainer member in the same direction.

Accordingly, as there is force acting from an electrode surface side, it causes force to act on the electrode surface, moving the plate spring member in one direction in which the plate spring member deforms by its displacement. As a result, there is a misalignment of the electrode in contact with the plate spring member. Further, when the electrode is in contact with the ion exchange membrane, there is a possibility of doing damage to the ion exchange membrane upon the misalignment of the electrode.

To address such problems, the applicant has already proposed in Japanese Patent No. 3501453 an electrolyzer wherein a plate with a plate spring member attached to it is located at a plate form of electrode chamber partition, a collector, etc., and the plate spring member is designed to have fingers or digits extending alternately in the opposite directions, so that when the electrode surface is urged against the plate spring member, the spacing between the electrode and the counter electrode is kept at a given magnitude without inconveniences such as transverse displacement of the electrode.

SUMMARY

An object of the invention is to provide an ion exchange membrane electrolzyer in which a plate form of electrode chamber partition, a collector and so on are provided a plate with a plate spring member attached to it, wherein the plate spring member has fingers or digits extending alternately in the opposite directions, and which is easy to assemble with high accuracy, and is not susceptible of any transverse displacement of the electrode in contact with the plate spring member.

According to the invention, this object is achieved by the provision of an ion exchange membrane electrolyzer, characterized in that a current is passed through at least one electrode in contact with a plate spring member formed at a portion of an electrode retainer member parallel with a flat plate form of electrode chamber partition, wherein said electrode retainer member is joined at a belt junction to the flat plate form of electrode chamber partition with a space between them, said electrode is provided with a floating mount means at a portion thereof other than a portion of contact with the plate spring member, and said floating mount means is provided with an engaging portion that is engaged with a fixed engaging member to enable said electrode to move in a perpendicular direction to an electrode surface and in a range of displacement of said plate spring member.

In an embodiment of the invention, the aforesaid floating mount means includes an electrode mount portion and legs having an engaging portion in engagement with said engaging member, wherein at least one of the legs of said floating mount means is engaged within an engaging portion comprising an opening formed at a wall surface upright in a perpendicular direction to an electrode chamber partition surface, so that the at lest one leg is movable only in a perpendicular direction to the electrode surface.

In an embodiment of the invention, the aforesaid plate spring member an interdigital spring member with a plurality of fingers or digits of identical length extending obliquely from the plate member of the electrode retainer member.

In an embodiment of the invention, the plate member with the plate spring member coupled thereto is formed at a portion of the electrode retainer member parallel with the flat plate form of electrode chamber partition, wherein said electrode retainer member is joined at the belt junction to the flat plate form of electrode chamber partition with a space between them, and the space formed between the electrode retainer member and the electrode chamber partition defines a downcomer for an electrolyte and an ascending passage for the electrolyte is formed on an electrode side.

In the ion exchange membrane electrolyzer of the invention, at least one electrode is retained by the interdigital plate spring member, and there is the floating mount means provided to the electrode, which enables the plate spring member to move in an acceptable amount only in the perpendicular direction to the electrode surface. Thus, the predetermined inter-electrode space can be kept without any transverse electrode displacement, and even when abnormal pressure pops up and there is force generated from the counter electrode, the ion exchange membrane electrolyzer can be kept running on, because it reverts to the original state after depressurization.

BRIEF DESCRIPTION OF THE DRAWINGS

The invention will be described with reference to the accompanying drawings, wherein like numbers reference like elements.

DESCRIPTION OF EXEMPLARY EMBODIMENTS

According to the invention, it has now been found regarding an electrolyzer wherein a plate with a plate spring member attached to it is located on a plate form of electrode chamber partition, a collector, etc. that a transverse displacement of an electrode in an ion exchange membrane electrolyzer in which electrodes are brought into contact with one another with an inter-digital plate spring member having fingers or digits extending alternately in the opposite directions is prevented by a floating mount means adapted to limit the range of movement of the electrode in the direction perpendicular to an electrode surface.

As a result, there is no risk of doing damage to an ion exchange membrane in contact with the electrode surface, and it is possible to set a distance of even an electrode of large area from an ion exchange membrane at a desired magnitude with no displacement of that electrode.

The invention is now explained with reference to the accompanying drawings.

Figure 1A:
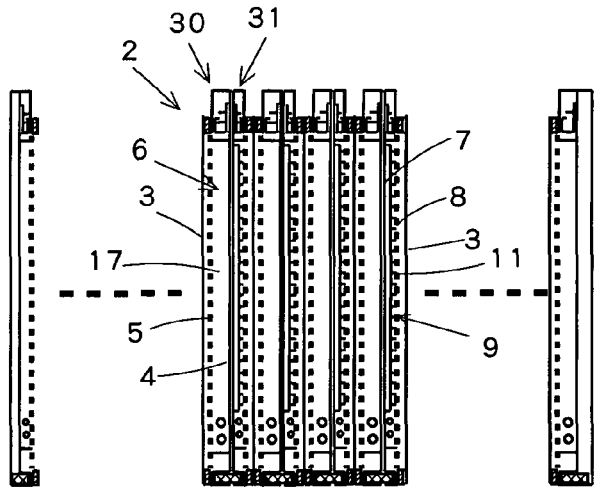
FIG. 1A is illustrative in section of an ion exchange membrane electrolyzer comprising a plurality of electrolyzer units stacked one upon another; it is illustrative of one embodiment of the electrolzyer according to the invention.
Figure 1B:
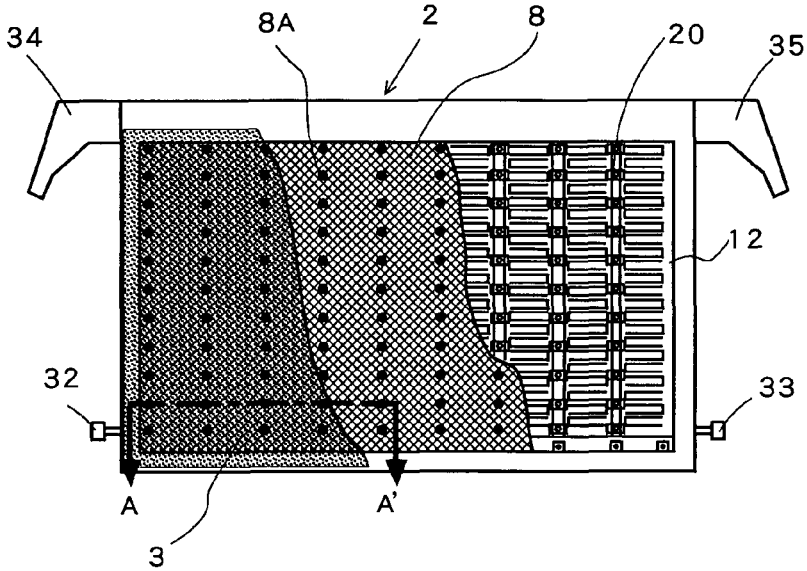
FIG. 1B is a plan view of the electrolzyer unit, as viewed from the cathode side.
Figure 1C:
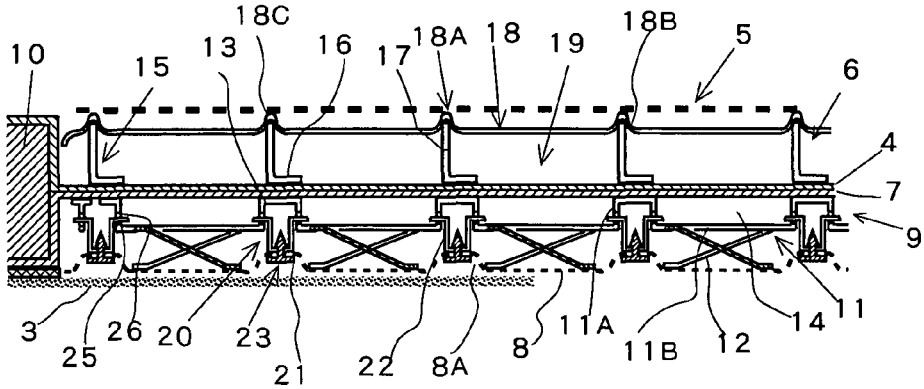
FIG. 1C is a sectional view of FIG. 1B, as sectioned on line A-A'.

FIG. 1A is illustrative of one embodiment of the electrolyzer of the invention; it is illustrative in section of an ion exchange membrane electrolyzer built up of a plurality of electrolyzer units stacked one upon another. FIG. 1B is a plan view of the electrolzyer unit, as viewed from the negative electrode, and FIG. 1C is a sectional view of FIG. 1B, as sectioned on line A-A'.

As shown in FIG. 1A, an ion exchange membrane electrolyzer shown generally at 1 is assembled by stacking a plurality of bipolar electrolyzer units 2 one upon another through an ion exchange membrane 3.

Each electrolyzer unit 2 has an anode 5 spaced away from an anode chamber partition 4 to define an anode chamber 6 between them. A cathode 8 is spaced away from a cathode chamber partition 7, and there is a cathode chamber 9 defined between the cathode chamber partition 7 and the ion exchange membrane 3. Around the electrolzyer unit 2, there is a framework member 10 provided to prevent deformation of the electrolyzer unit 2.

On the anode chamber 6 and the cathode chamber 9, there are anode chamber-side gas-liquid separation means 30 and cathode chamber-side gas-liquid separation means 31 provided, respectively.

The anode chamber 6 of the electrolzyer unit 2 is provided with an anolyte feed pipe 32, and the anode chamber-side gas-liquid separation means 30 is provided with an anode chamber discharge pipe 34 for discharging an anolyte having a decreased concentration and gases.

The cathode chamber 6 of the electrolyzer unit 2 is provided with a catholyte feed pipe 33, and the anode chamber-side gas-liquid separation means 31 is provided with a cathode chamber discharge pipe 35 for discharging an catholyte having a decreased concentration and gases.

While it is shown and described that the anolyte feed pipe and the catholyte discharge pipe are located on the same side, respectively, it is contemplated that the feed pipe may be opposed to the discharge pipe, and the anolyte feed pipe and the catholite feed pipe may be located on the same side.

As shown in FIGS. 1B and 1C, the cathode chamber partition 7 is provided with a plate spring retainer member 11, and a cathode 8 comes in conductive contact with the distal ends of a plurality of interdigital plate spring pairs 12 extending obliquely from the plate spring retainer member 11. Each inter-digital plate spring 12 has fingers or digits located alternately in the opposite directions. On the surface of the cathode 8 there is an ion exchange membrane 3 located.

The cathode 8 comes in contact with the plate spring digits 12 extending from the plate spring retainer member 11 in the opposite directions; that is, only force in the perpendicular direction to the cathode chamber partition exerts on the cathode 8. As a consequence, the cathode is displaced by the repulsive force of the plate spring digits 12 in the direction at right angles with the cathode chamber partition 7, but there is no translation of the cathode 8 parallel with the cathode chamber partition 7. It is thus possible to regulate the cathode 8 at a given position without offering problems such as damage to the ion exchange membrane surface.

The plate spring retainer member 11 is tightly joined at a belt junction 13 to the cathode chamber partition 7. The plate spring retainer member 11 is made up of a longitudinal portion 11A connected to the junction 13 and a transverse portion 11B parallel with the cathode chamber partition intersecting at right angles with the longitudinal portion. The mutually opposite spring digits 12 are alternately inserted into the transverse portion 11B, and there is a catholyte circulation passage 14 defined between the plate spring retainer member 11 and the cathode chamber partition 7.

As a result, a gas-liquid mixture fluid ascending through a space on the side of the cathode 8 surface is subjected to gas-liquid separation at the upper portion of the cathode chamber, whereupon a part of the separated electrolyte flows out of the electrolyzer via the cathode chamber discharge pipe 35, and another descends down a catholyte circulation passage 14, flowing into a space on the side of the cathode surface via the bottom of the cathode chamber. This electrolyte is mixed with a catholyte fed from the catholyte feed pipe 33 and jetted into the cathode chamber for electrolysis at the cathode.

Thus, the circulation of the electrolyte in the cathode chamber is so accelerated that the concentration distribution of the catholyte becomes uniform, contributing to efficient electrolysis.

On the other hand, the bottom 16 of an L-shaped anode retainer member 15 is joined to the anode chamber partition 4, and the distal end 17 of that member 15 at right angles with the bottom is joined to the junction 18A of a plate form of downcomer 18. Because the anode retainer member 15 has both functions of holding the anode 5 and feeding electricity to the anode 5, it is preferable that the bottom 16 of the anode retainer member 15 is located on the back surface of the junction 13 of the cathode chamber partition 7 so as to reduce resistance to conduction.

The junction 18A is provided with a concavity 18B on the side of the anode chamber partition 4 for stably receiving the anode retainer member 15, and the anode 5 is joined to a convexity 18C jutting toward the side of the anode 5.

And, a gas-liquid mixture fluid ascending through a space of the downcomer 18 on the side of the anode 5 surface is subjected to gas-liquid separation at the upper portion of the anode chamber, whereupon a part of the anolyte descends down an anolyte circulation passage 19, and a part of the electrolyte flows out of the anolyte discharge pipe 34. And, the anolyte descending down the anolyte circulation passage 19 flows into a space on the side of the anode surface at the lower portion of the electrode chamber on the anode side, whereupon it is mixed with the anolyte fed from the anolyte feed pipe 32 provided at the electrolyzer for electrolysis at the anode surface.

The ion exchange membrane electrolyzer of the invention is characterized in that a floating mount means 20 is fixed to a portion of the cathode 8 except portions with the plate spring member.

A portion of the floating mount means 20 to which the cathode is attached, viz., an electrode joining portion 21 is joined to the side of the cathode 8 opposite to the counter electrode, viz., at a concavity 8A formed on the side of the anode surface. Note here that the concavity 8A formed at the cathode 8 has a depth enough to prevent the vertex of a coupler member 23 from jutting out of the counter electrode surface even when there is a slight fluctuation of the cathode 8 or the like.

The floating mount means 20 is also adapted to move a given distance in the direction at right angles with the cathode chamber partition 7, whereby the translation of the cathode parallel with the cathode chamber partition is limited to enable the inter-electrode spacing to be adjusted by the plate spring member 12.

The floating mount means 20 includes an electrode coupling portion 21 adapted to couple to the electrode and a coupling hole 22 formed in the electrode coupling portion 21. The floating mount means 20 couples to the cathode 8 by means of the coupler member 23 mounted in the coupling hole, and includes an engaging portion 25 provided at a leg portion 24, which engages within an opening portion 26 in the longitudinal portion 11A of the plate spring retainer member 11.

As a result, the floating mount means can move in the direction at right angles with the cathode chamber partition, so that the position of the cathode in the direction at right angles with the cathode chamber partition can be regulated.

For the plate spring member and the plate spring retainer member, use may be made of nickel, nickel alloys, stainless or the like that are of corrosion resistance in an environment prevailing in the cathode chamber, and for the cathode, use may be made of porous members of nickel or nickel alloys, networks, expanded metal, or a substrate made of these materials and provided on its surface with a coating of an electrode catalyst material such as a raney nickel-containing layer or an activated charcoal-containing nickel layer so as to lower hydrogen overpressure.

The plate spring member may be sized depending on the electrode surface area of the electrolyzer involved, etc., and have a thickness of 0.2 mm to 0.5 mm, a width of 2 mm to 10 mm, and a length of 20 mm to 50 mm.

While it is shown and described that the electrolyzer has plate spring interdigits provided on the cathode chamber side so that the space between the cathode contacting the plate spring member and the cathode chamber partition can be adjusted, it is contemplated that while the space between the cathode and the cathode chamber partition is fixed, the plate spring interdigits may be located on the anode chamber side so that the space between the anode and the anode chamber partition can be adjusted.

When the plate spring member and the plate spring retainer member are located on the anode side, use may be made of a metal capable of forming a thin film such as titanium, tantalum and zirconium or their alloy, and for the anode, use may be made of a metal capable of forming a thin film such as titanium, tantalum and zirconium or their alloy provided on its surface with a coating of an electrode catalyst substance containing a platinum-group metal or an oxide of a platinum-group metal.

Figure 2A:
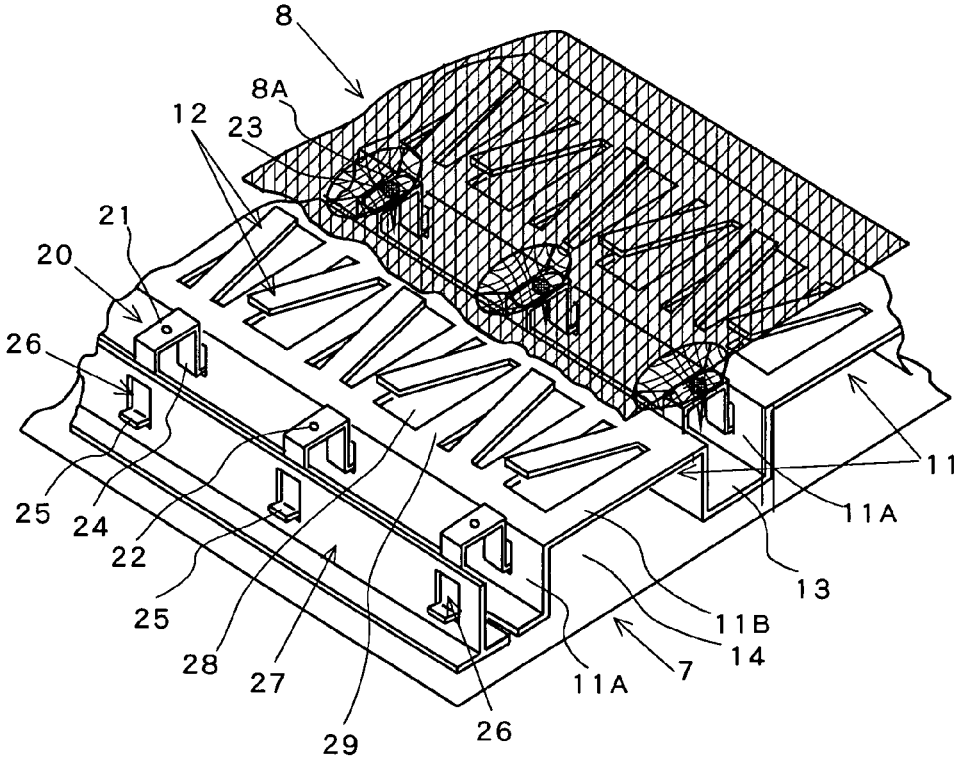
FIG. 2A is illustrative of what state the floating mount means of the invention is mounted in; it is a partly cut-away perspective view of the cathode on a side adjacent to the framework of the electrolyzer unit.

FIG. 2A is illustrative of what state the floating mount means of the invention is mounted in; it is a partly cut-away perspective view of the cathode on a side adjacent to the framework of an electrolyzer unit.

The plate spring retainer member 11 is tightly joined at the belt junction 13 to the cathode chamber partition 7.

The interdigital plate spring retainer 11 is built up of the longitudinal portion 11A connected to the junction 13 and the transverse portion 11B parallel with the cathode chamber partition. That transverse portion 11B is provided with the interdigital plate spring with digits alternately arranged in opposite directions in a comb form, and between the plate spring retainer member 11 and the cathode chamber partition 7 there is the catholyte circulation passage 14 provided.

A floating mount means 20 includes an electrode coupling portion 21 adapted to couple to the electrode, and the electrode coupling portion has a coupling hole 22. By the coupler member 23 engaged within the coupling hole 22, the electrode coupling portion couples at a concavity 8A formed in the cathode 8 to the electrode.

The depth of the concavity 8A is determined such that the coupler member 23 does not jut from the counter electrode surface of the cathode 8, and the leg 24 of the floating mount means 20 is provided with an engaging portion 24 that is in engagement within an opening 26 formed in the longitudinal portion 11A of the plate spring retainer member 11.

The spacing between both legs 24 of the floating mount means 20 is sized such that it is positioned in a space between two oppositely located longitudinal portions 11A so that it can move smoothly within the opening 26 in the direction perpendicular to the cathode surface. On the other hand, the opening 26, within which the engaging portions 25 of the legs of the floating mount means are engaged, is sized in the width direction such that they can move smoothly in the direction at right angles with the width direction of the openings.

Consequently, the floating mount means 20 has its movement limited to only the direction at right angles with the cathode chamber partition 7; that is, it can be stably held with an adjustable distance from the cathode chamber partition in the perpendicular direction yet without displacements parallel with the cathode chamber partition.

The interdigital plate spring member 12 may be joined to the plate spring retainer member 11 by any desired method. However, it is preferable that a plate is cut with digits hauled up in one direction for integration with the plate spring retainer member 11.

When the interdigital plate spring member 12 is made in a form integral with the plate spring retainer member 11, an opening 28 and a solid portion 29 remain formed between adjoining digits 12 on a plane projected onto the cathode partition surface. The solid portion 29 has a function of increasing the rigidity of the inter-digital plate spring retainer member 12, thereby making smoother the movement of the cathode in contact with the interdigital plate spring member 12.

The solid portion 29 need not be provided all between the plate spring digits; how many solid portions are provided and where they are provided may be determined in consideration of the rigidity of the material, etc.

Figure 2B:
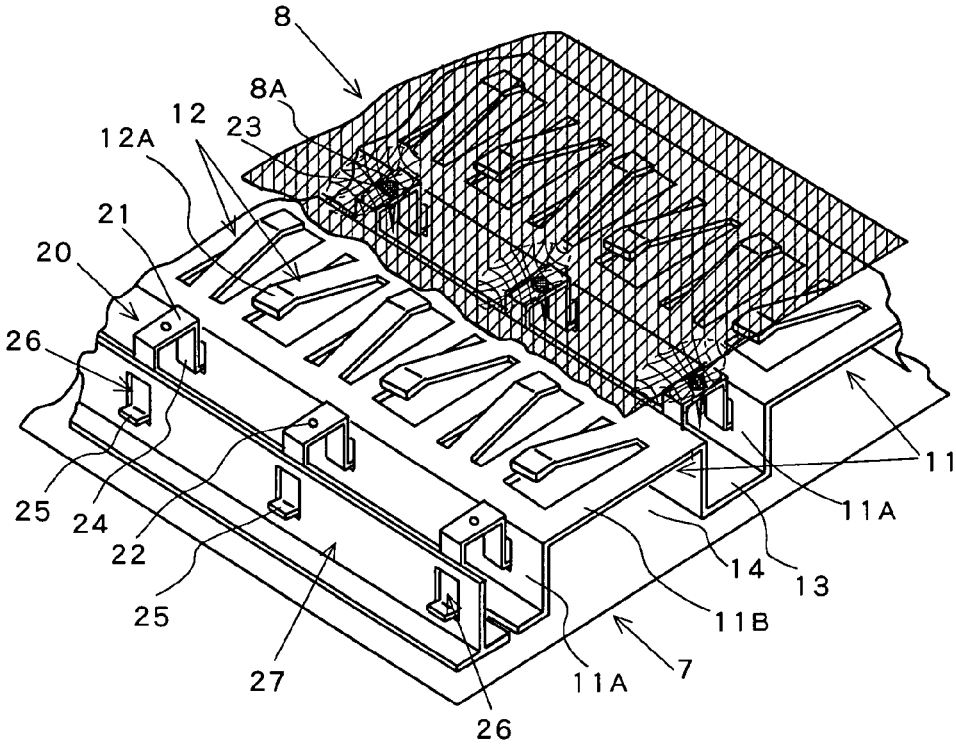
FIG. 2B is illustrative of another state of the floating mount means of the invention mounted in place.

FIG. 2B is a perspective view of another state where the floating mount means of the invention is mounted in place. This embodiment is different from the foregoing embodiment in that the distal ends of the digits in contact with the cathode are bent substantially parallel with the cathode partition surface 7 into contact portions 12A that are in contact with the electrode.

As the spacing between the cathode 8 and the plate spring retainer member 11 becomes narrow, it makes smooth the movement of the cathode 8 and the interdigital plate spring 12 and makes sure the conductive connection between the electrode and the inter digital plate spring member.

Figure 3A:
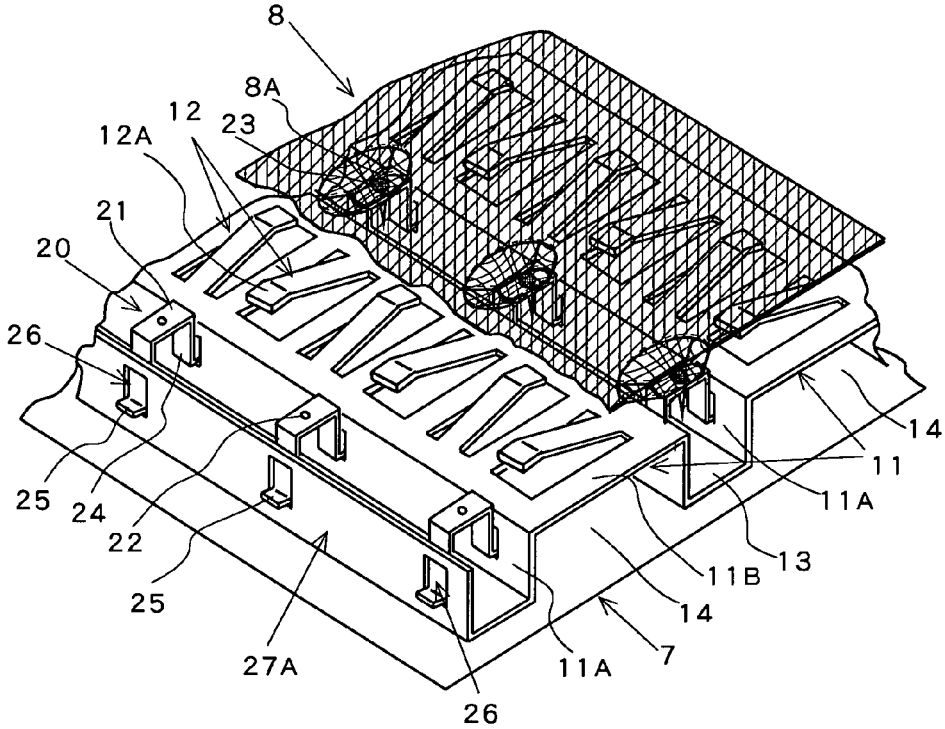
FIG. 3A is illustrative of yet another state of the floating mount means of the invention mounted in place; it is a partly cut-away perspective view of the electrode on a side adjacent to the framework of the electrolyzer unit.

FIG. 3A is illustrative of yet another state of mounting the floating mount member of the invention; it is a partly cutaway perspective view of the electrode adjacent to the framework of an electrolyzer unit.

What is nearest to the framework of the electrolyzer unit is built up of the longitudinal portion 11A of the plate spring retainer member 11 and a unitary floating mount means engagement member 27A that is located at the outermost end and integral with the plate spring retainer member 11 and extends from the belt junction 13 in the direction at right angles with the cathode chamber partition, as is the case with the longitudinal portion 11. And, the floating mount means 20 is engaged and retained within an opening 27 formed in the unitary floating mount means engagement member 27A extending in the direction at right angles with the cathode chamber partition, as is the case with the longitudinal portion 11.

In the electrolyzer exemplified here, the member adapted to be in engagement with all the floating mount means is made integral with the plate spring retainer member 11. Accordingly, electrolyzer units may be fabricated only by coupling the plate spring retainer member having openings for engagement with the floating mount means to the cathode chamber partition at the engagements of the floating mount means.

Figure 3B:
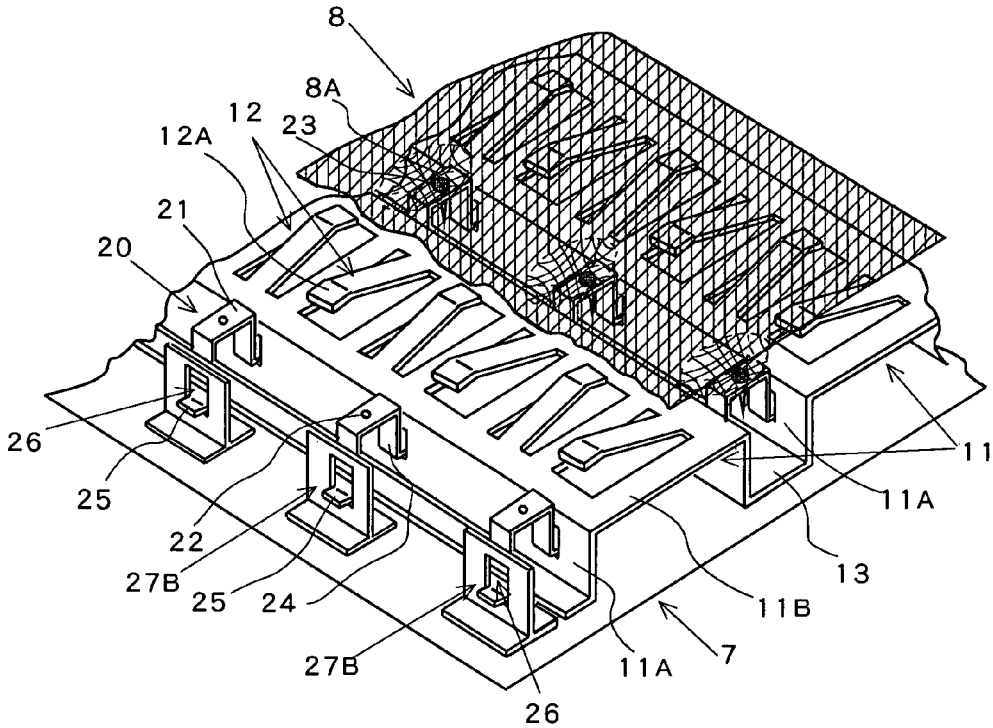
FIG. 3B is illustrative of a further state of the floating mount means of the invention mounted in place.

FIG. 3B is illustrative of a further state of mounting the floating mount member of the invention; it is a partly cutaway perspective view of the electrode adjacent to the framework of an electrolyzer unit. Nearest to the framework of the electrolyzer unit, an independent member 27B for engagement with the floating mount means is provided in opposition to the longitudinal portion 11A of the plate spring retainer member 11.

In the electrolyzer exemplified here, it is required that as many members as the floating mount means 20 be independently mounted, and so there are more assembling steps needed than in the previously noted embodiment. However, it is possible to save the amount of material used, and reduce influences on the flow of the electrolyte through the electrolyzer, etc.

Figure 4A:
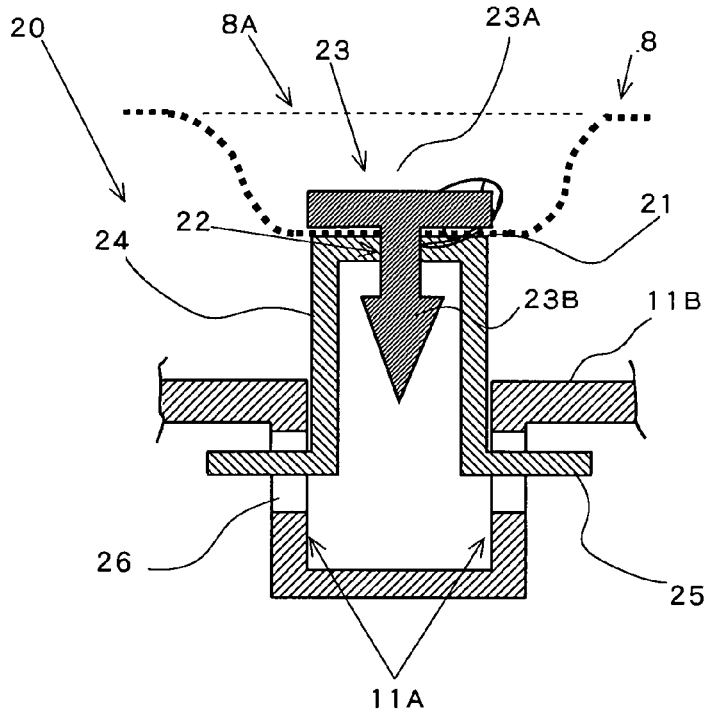
FIG. 4A is illustrative of one embodiment of the floating mount means of the invention; it is a sectional view thereof.

FIG. 4A is illustrative in section of one example of the floating mount means. The floating mount means 20 is fitted between two opposite longitudinal portions 11A of the plate spring retainer member 11, and a concavity 8A formed on the counter electrode side of the cathode 8, i.e., the anode surface side is fixed at an electrode coupling portion 21 by means of a coupler member 23 passing through a coupling hole 22.

The floating mount means 20 has legs 24 having engaging portions 25 engaged and regained within openings positioned at both its sides, so that its up-and-down movement is limited by the tops and bottoms of the openings. In addition, the engaging portions 25 are fitted within the two longitudinal portions 11A with a fabrication tolerance, so that the transverse and vertical movements (as viewed in the drawing sheet) of the engaging portions 25 are limited, and the electrode surface is retained at a given position while balanced against the repulsive force of the plate spring not shown.

The depth of the concavity 8A formed at the cathode 8 is preferably determined such that the vertex 23 of the electrode coupling portion 23 does not jut from the counter electrode surface even when there is some fluctuation of the cathode 8, etc.

Figure 4B:
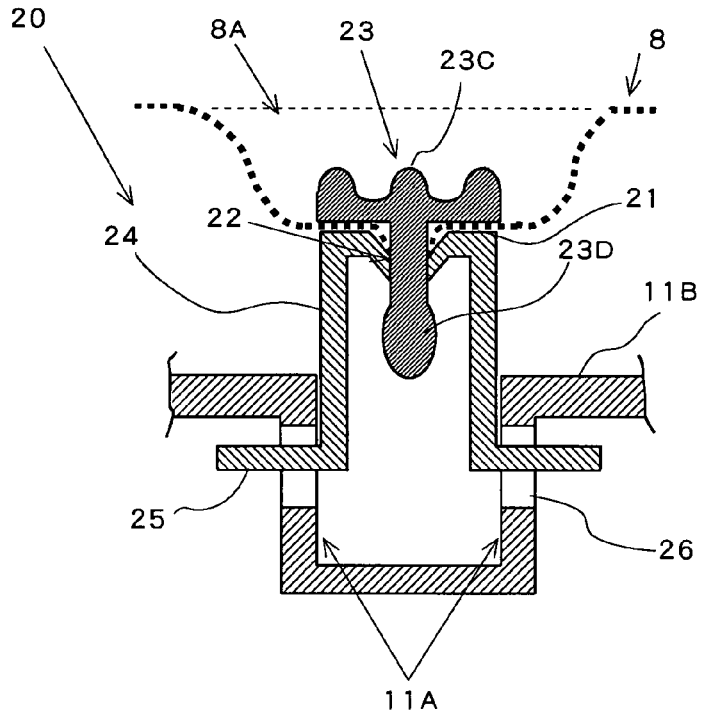
FIG. 4B is illustrative of another embodiment of the floating mount means of the invention; it is a sectional view thereof.

FIG. 4B is illustrative in section of another example of the floating mount means.

The floating mount means 20 shown in FIG. 4B is similar in structure to that shown in FIG. 4A, with the exception that the coupling portion 22 and coupler member 23 differ in structure.

The coupling portion 22 is provided with an inclined coupling hole 22A that has a diameter becoming small from a direction of receiving the coupler member 23, and is enlarged as the coupler member 23 is inserted and fixed.

Further, the head 23C and shaft 23D of the coupler member 23 are each configured into a round shape so that the resistance of the electrolyte to the coupler member 23 can be diminished.

Although the coupling of the floating mount means to the cathode may be achieved by various mount means, it is preferable to use a member capable of being engaged within the coupling hole provided in the coupling portion of the floating mount means, thereby coupling and fixing the floating mount means to the cathode, as shown in FIG. 4.

Any desired material little affected by an environment prevailing in the electrolyzer chamber could be used for the coupler member. For instance, use could be made of a coupler member made of materials stable in the electrolyte, for instance, rubber or fluororesin.

As shown, the floating mount means may be made by cutting a plate member to a width enough to make the floating mount means attachable to and movable in the opening 23, then forming the coupling hole 22 at the electrode coupling portion 21, then bending it down to form the legs 24, and then bending the tips of the legs 24 outwardly into the engaging portions 25 having a given length.

Instead of that plate member, use could also be made of a wire material, an expanded metal material or the like.

When the electrolyzer of the invention is used for the electrolysis of an aqueous solution of an alkaline metal halide, for instance, brine, saturated brine is fed to the anode chamber while water or a diluted aqueous solution of sodium hydroxide is supplied to the cathode chamber. After the completion of electrolysis at a given electrolysis rate, these solutions are taken out of the electrolyzer.

In the electrolysis of brine in the ion exchange membrane electrolyzer, electrolysis takes place while the pressure of the cathode chamber is kept higher than the pressure of the anode chamber, and the ion exchange membrane is in close contact with the anode. In this case, however, the cathode is retained by the flexible plate spring member so that it can be positioned close to the ion exchange membrane surface a given distance. Even when the pressure on the anode chamber side grows high upon anything wrong popping up, the electrolyzer can be kept running on after depressurization, because the plate spring member has large restoring force.

In the ion exchange membrane electrolyzer of the invention, at least one electrode is retained by the interdigital plate spring member, and there is the floating mount means provided, which enables the plate spring member to be moved in an acceptable amount. Thus, the predetermined inter-electrode space can be kept without any transverse electrode displacement, and even when abnormal pressure pops up and there is counter force generated from the counter electrode, the ion exchange membrane electrolyzer can be kept running on, because it rights itself after depressurization.

What is claimed is:

1. An ion exchange membrane electrolyzer, comprising:

at least one electrode in contact with a plate spring member formed at a portion of an electrode retainer member parallel with a flat plate form of electrode chamber partition, wherein said electrode retainer member is joined at a belt junction to the flat plate form of electrode chamber partition with a space between them, said electrode is provided with a floating mount means at a portion thereof other than a portion of contact with the plate spring member, and said floating mount means is provided with an engaging portion that is engaged with a fixed engaging member to enable said electrode to move in a perpendicular direction to an electrode surface and in a range of displacement of said plate spring member.

2. The ion exchange membrane electrolyzer according to claim 1, characterized in that said floating mount means includes an electrode mount portion and legs having an engaging portion in engagement with said engaging member, wherein at least one of the legs of said floating mount means is engaged within an engaging portion comprising an opening formed at a wall surface upright in a perpendicular direction to an electrode chamber partition surface, so that the at lest one leg is movable only in a perpendicular direction to the electrode surface.

3. The ion exchange membrane electrolyzer according to claim 1, characterized in that the plate spring member is an interdigital spring member with a plurality of fingers or digits of identical length extending obliquely from the plate member of the electrode retainer member.

4. The ion exchange membrane electrolyzer according to claim 2, characterized in that the plate spring member is an interdigital spring member with a plurality of fingers of identical length extending obliquely from the plate member of the electrode retainer member.

5. The ion exchange membrane electrolyzer according to claim 1, characterized in that the plate member with the plate spring member coupled thereto is formed at a portion of the electrode retainer member parallel with the flat plate form of electrode chamber partition, wherein said electrode retainer member is joined at the belt junction to the flat plate form of electrode chamber partition with a space between them, and the space formed between the electrode retainer member and the electrode chamber partition defines a downcomer for an electrolyte and an ascending passage for the electrolyte is formed on an electrode side.

6. The ion exchange membrane electrolyzer according to claim 2, characterized in that the plate member with the plate spring member coupled thereto is formed at a portion of the electrode retainer member parallel with the flat plate form of electrode chamber partition, wherein said electrode retainer member is joined at the belt junction to the flat plate form of electrode chamber partition with a space between them, and the space formed between the electrode retainer member and the electrode chamber partition defines a downcomer for an electrolyte and an ascending passage for the electrolyte is formed on an electrode side.

7. The ion exchange membrane electrolyzer according to claim 3, characterized in that the plate member with the plate spring member coupled thereto is formed at a portion of the electrode retainer member parallel with the flat plate form of electrode chamber partition, wherein said electrode retainer member is joined at the belt junction to the flat plate form of electrode chamber partition with a space between them, and the space formed between the electrode retainer member and the electrode chamber partition defines a downcomer for an electrolyte and an ascending passage for the electrolyte is formed on an electrode side.

8. The ion exchange membrane electrolyzer according to claim 4, characterized in that the plate member with the plate spring member coupled thereto is formed at a portion of the electrode retainer member parallel with the flat plate form of electrode chamber partition, wherein said electrode retainer member is joined at the belt junction to the flat plate form of electrode chamber partition with a space between them, and the space formed between the electrode retainer member and the electrode chamber partition defines a downcomer for an electrolyte and an ascending passage for the electrolyte is formed on an electrode side.

* * * * *